US011867166B2

(12) United States Patent
Tanaka et al.

(10) Patent No.: US 11,867,166 B2
(45) Date of Patent: Jan. 9, 2024

(54) PIEZOELECTRIC PUMP WITH ANNULAR VALVE ARRANGEMENT

(71) Applicant: Murata Manufacturing Co., Ltd., Kyoto (JP)

(72) Inventors: Nobuhira Tanaka, Kyoto (JP); Masaaki Fujisaki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 396 days.

(21) Appl. No.: 17/365,323

(22) Filed: Jul. 1, 2021

(65) Prior Publication Data

US 2021/0324844 A1 Oct. 21, 2021

Related U.S. Application Data

(63) Continuation-in-part of application No. PCT/JP2020/001333, filed on Jan. 16, 2020.

(30) Foreign Application Priority Data

Mar. 27, 2019 (JP) ..... 2019-061038

(51) Int. Cl.
*F04B 43/04* (2006.01)

(52) U.S. Cl.
CPC ..... *F04B 43/046* (2013.01)

(58) Field of Classification Search
CPC .... F04B 43/046; F04B 45/041; F04B 45/047; F04B 53/10
See application file for complete search history.

(56) References Cited

U.S. PATENT DOCUMENTS

| | | | | |
|---|---|---|---|---|
| 10,697,450 | B2 * | 6/2020 | Tanaka | F04B 19/22 |
| 10,788,034 | B2 * | 9/2020 | Ganti | F04B 45/043 |
| 11,391,277 | B2 * | 7/2022 | Tanaka | F04B 45/047 |
| 11,441,555 | B2 * | 9/2022 | Tanaka | F04B 45/047 |
| 2010/0074775 | A1 * | 3/2010 | Yamamoto | F04B 43/046 417/413.2 |

(Continued)

FOREIGN PATENT DOCUMENTS

| | | | |
|---|---|---|---|
| JP | 2009-74418 | A | 4/2009 |
| JP | 2009-156454 | A | 7/2009 |

(Continued)

OTHER PUBLICATIONS

International Search Report issued in Application No. PCT/JP2020/001333, dated Mar. 3, 2020.

(Continued)

*Primary Examiner* — Nathan C Zollinger
(74) *Attorney, Agent, or Firm* — Pearne & Gordon LLP

(57) ABSTRACT

A piezoelectric pump includes a first top board, a second top board, a diaphragm, a first side wall, a second side wall, a first valve, and a second valve. The first valve has an annular shape to surround the first aperture while being spaced apart from the first aperture and the second aperture, and is disposed in the first pump chamber between the first aperture and the second aperture when viewed in a plan. The second valve has an annular shape to surround the third aperture while being spaced apart from the third aperture and the fourth aperture, and is disposed in the second pump chamber between the third aperture and the fourth aperture when viewed in a plan.

20 Claims, 10 Drawing Sheets

(56) References Cited

U.S. PATENT DOCUMENTS

| | | | | |
|---|---|---|---|---|
| 2010/0215522 | A1 | 8/2010 | Kawamura et al. | |
| 2015/0023821 | A1 | 1/2015 | Campbell et al. | |
| 2017/0218949 | A1 | 8/2017 | Yokoi et al. | |
| 2020/0370544 | A1* | 11/2020 | Tanaka | F04B 17/003 |
| 2021/0010467 | A1 | 1/2021 | Fujisaki et al. | |
| 2021/0324844 | A1* | 10/2021 | Tanaka | F04B 45/047 |

FOREIGN PATENT DOCUMENTS

| | | | |
|---|---|---|---|
| JP | 2010-223218 | A | 10/2010 |
| JP | 2019-039436 | A | 3/2019 |
| WO | 2016/013390 | A1 | 1/2016 |
| WO | 2019/230159 | A1 | 12/2019 |
| WO | 2019/230160 | A1 | 12/2019 |

OTHER PUBLICATIONS

Written Opinion issued in Application No. PCT/JP2020/001333, dated Mar. 3, 2020.

* cited by examiner

PIEZOELECTRIC PUMP WITH ANNULAR VALVE ARRANGEMENT

CROSS REFERENCE TO RELATED APPLICATION

This is a continuation of International Application No. PCT/JP2020/001333 filed on Jan. 16, 2020 which claims priority from Japanese Patent Application No. 2019-061038 filed on Mar. 27, 2019. The contents of these applications are incorporated herein by reference in their entireties.

BACKGROUND OF THE DISCLOSURE

Field of the Disclosure

The present disclosure relates to a piezoelectric pump.

Description of the Related Art

Piezoelectric pumps including a piezoelectric element have been disclosed thus far (refer to, for example, Patent Document 1).

A piezoelectric pump according to Patent Document 1 includes a diaphragm to which a piezoelectric element is bonded, a first top board and a second top board disposed on opposite main surfaces of the diaphragm, a first side wall, and a second side wall. The first side wall couples the diaphragm to the first top board, and the second side wall couples the diaphragm to the second top board. A space defined by the first top board, the diaphragm, and the first side wall serves as a first pump chamber. A space defined by the second top board, the diaphragm, and the second side wall serves as a second pump chamber. Both pump chambers are separated by the diaphragm.

The first top board has an inlet port and an outlet port. The second top board also has an inlet port and an outlet port. The respective outlet ports are formed from multiple apertures, and selectively opened or closed with a film-shaped valve disposed in the pump chambers.

When the piezoelectric element in such a structure receives alternating current (AC) power, the piezoelectric element causes unimorph bending deformation, and causes pressure changes in the internal spaces in the first pump chamber and the second pump chamber. In accordance with the pressure changes, the valves disposed in the pump chambers alternately move between the position where it opens the outlet port and the position where it closes the outlet port.

Patent Document 1: U.S. Patent Application Publication No. 2015/0023821

BRIEF SUMMARY OF THE DISCLOSURE

Each valve that opens or closes the outlet port repeatedly collides against the edge of the outlet port. The repeated collision of the valve against the edge of the outlet port may damage the valve, and degrade the performance of the valve. This may lower the reliability of the piezoelectric pump.

An object of the present disclosure is to solve the above problem, and to provide a piezoelectric pump with improved reliability.

To achieve the above object, the piezoelectric pump according to the present disclosure includes a first top board in which a first aperture and a second aperture are formed, a second top board that is spaced apart from the first top board and in which a third aperture and a fourth aperture are formed, a diaphragm disposed between the first top board and the second top board, and to which a piezoelectric element is attached, a first side wall coupling the first top board and the diaphragm to define a first pump chamber between the first top board and the diaphragm, a second side wall coupling the second top board and the diaphragm to define a second pump chamber between the second top board and the diaphragm, a first valve having an annular shape to surround the first aperture while being spaced apart from the first aperture and the second aperture, and disposed in the first pump chamber between the first aperture and the second aperture when viewed in a plan from a main surface of the first top board toward a main surface of the second top board, and a second valve having an annular shape to surround the third aperture while being spaced apart from the third aperture and the fourth aperture, and disposed in the second pump chamber between the third aperture and the fourth aperture when viewed in a plan from the main surface of the second top board toward the main surface of the first top board.

The piezoelectric pump according to the present disclosure can improve the reliability.

DETAILED DESCRIPTION OF THE DISCLOSURE

Figure 1:
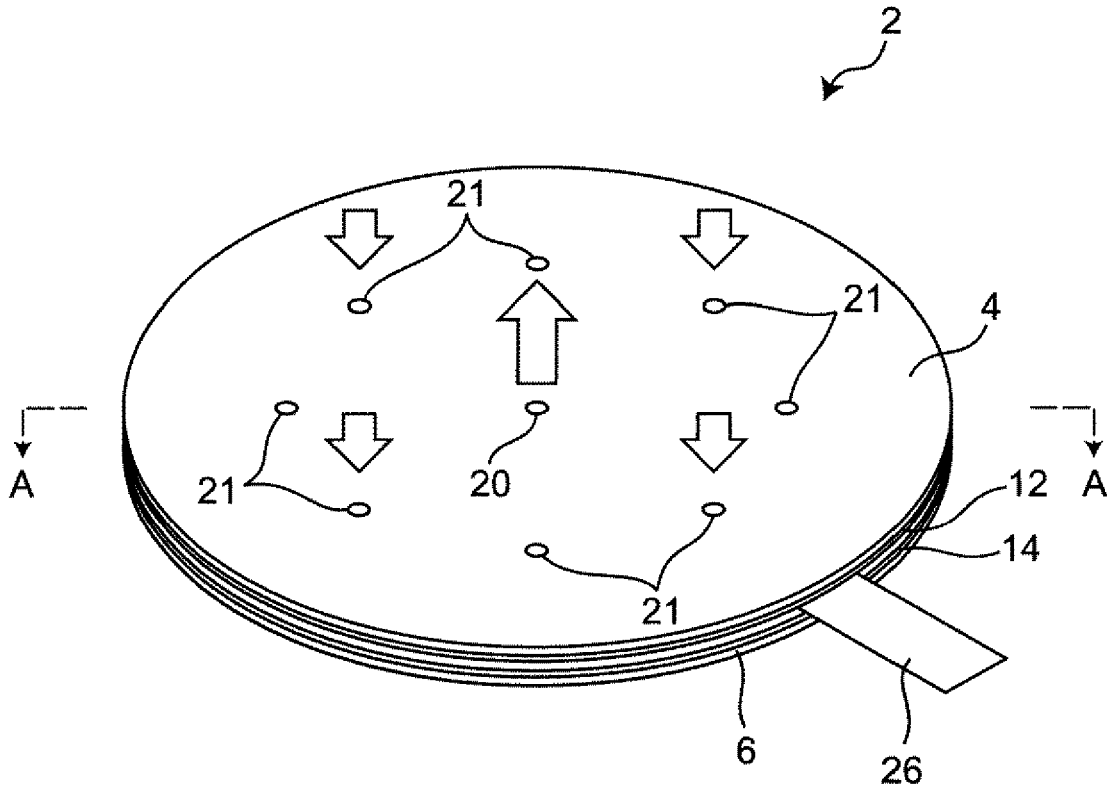
FIG. 1 is a perspective view of a piezoelectric pump according to a first embodiment.

A first aspect of the present disclosure provides a piezoelectric pump that includes a first top board in which a first aperture and a second aperture are formed, a second top board that is spaced apart from the first top board and in which a third aperture and a fourth aperture are formed, a diaphragm disposed between the first top board and the second top board, and to which a piezoelectric element is attached, a first side wall coupling the first top board and the diaphragm to define a first pump chamber between the first top board and the diaphragm, a second side wall coupling the second top board and the diaphragm to define a second pump chamber between the second top board and the diaphragm, a first valve having an annular shape to surround the first aperture while being spaced apart from the first aperture and the second aperture, and disposed in the first pump chamber between the first aperture and the second aperture when viewed in a plan from a main surface of the first top board toward a main surface of the second top board, and a second valve having an annular shape to surround the third aperture while being spaced apart from the third aperture and the fourth aperture, and disposed in the second pump chamber between the third aperture and the fourth aperture when viewed in a plan from the main surface of the second top board toward the main surface of the first top board.

In this structure, the valves are spaced apart from the apertures, prevented from colliding against the edges of the apertures, and thus prevented from being damaged. This structure can thus extend the lives of the valves, and improve the reliability of the piezoelectric pump.

A second aspect of the present disclosure provides the piezoelectric pump according to the first aspect, wherein the first valve includes a first fixed portion fixed to the first top board, and a first movable portion extending from the first fixed portion, and wherein the second valve includes a second fixed portion fixed to the second top board, and a second movable portion extending from the second fixed portion. In this structure, the valves are fixed to the top boards. This structure can reduce the vibrations of the fixed portions of the valves more than when the valves are fixed to the vibrator. This structure can thus reduce an excessive vibration loss, and achieve large vibration displacement, a high flow rate, and high pressure characteristics.

A third aspect of the present disclosure provides the piezoelectric pump according to the first aspect, wherein the first valve includes a third fixed portion fixed to the diaphragm, and a third movable portion extending from the third fixed portion, and wherein the second valve includes a fourth fixed portion fixed to the diaphragm, and a fourth movable portion extending from the fourth fixed portion. In this structure, the valves are fixed to the diaphragm. This structure can reduce flow path resistance near the top boards, and achieve a high flow rate.

A fourth aspect of the present disclosure provides the piezoelectric pump according to the second aspect, wherein the first movable portion of the first valve is disposed on an inner side of the first fixed portion of the first valve when viewed in a plan from the main surface of the first top board toward the main surface of the second top board, and wherein the second movable portion of the second valve is disposed on an inner side of the second fixed portion of the second valve when viewed in a plan from the main surface of the second top board toward the main surface of the first top board. This structure can accelerate a flow of air that flows from the outside of the piezoelectric pump into the first pump chamber through the second aperture and then flows out through the first aperture, and a flow of air that flows from the outside of the piezoelectric pump into the second pump chamber through the fourth aperture and then flows out through the third aperture.

A fifth aspect of the present disclosure provides the piezoelectric pump according to the third aspect, wherein the third movable portion of the first valve is disposed on an inner side of the third fixed portion of the first valve when viewed in a plan from the main surface of the first top board toward the main surface of the second top board, and wherein the fourth movable portion of the second valve is disposed on an inner side of the fourth fixed portion of the second valve when viewed in a plan from the main surface of the second top board toward the main surface of the first top board. This structure can accelerate a flow of air that flows from the outside of the piezoelectric pump into the first pump chamber through the second aperture and then flows out through the first aperture, and a flow of air that flows from the outside of the piezoelectric pump into the second pump chamber through the fourth aperture and then flows out through the third aperture.

A sixth aspect of the present disclosure provides the piezoelectric pump according to the second aspect, wherein the first movable portion of the first valve is disposed on an outer side of the first fixed portion of the first valve when viewed in a plan from the main surface of the first top board toward the main surface of the second top board, and wherein the second movable portion of the second valve is disposed on an outer side of the second fixed portion of the second valve when viewed in a plan from the main surface of the second top board toward the main surface of the first top board. This structure can accelerate a flow of air that flows from the outside of the piezoelectric pump into the first pump chamber through the first aperture and then flows out through the second aperture, and a flow of air that flows from the outside of the piezoelectric pump into the second pump chamber through the third aperture and then flows out through the fourth aperture.

A seventh aspect of the present disclosure provides the piezoelectric pump according to the third aspect, wherein the third movable portion of the first valve is disposed on an outer side of the third fixed portion of the first valve when viewed in a plan from the main surface of the first top board toward the main surface of the second top board, and wherein the fourth movable portion of the second valve is disposed on an outer side of the fourth fixed portion of the second valve when viewed in a plan from the main surface of the second top board toward the main surface of the first top board. This structure can accelerate a flow of air that flows from the outside of the piezoelectric pump into the first pump chamber through the first aperture and then flows out through the second aperture, and a flow of air that flows from the outside of the piezoelectric pump into the second pump chamber through the third aperture and then flows out through the fourth aperture.

An eighth aspect of the present disclosure provides a piezoelectric pump according to any of the first to seventh aspects, wherein the diaphragm separates the first pump chamber from the second pump chamber to disable connection between the first pump chamber and the second pump chamber. This structure can cause separate airflows in the first pump chamber and the second pump chamber.

A ninth aspect of the present disclosure provides a piezoelectric pump according to any one of the first to eighth aspects, wherein the diaphragm includes a supporter including a first main surface to which the piezoelectric element is attached, and the supporter supporting the piezoelectric element, a vibrator attached to a second main surface of the supporter at a position across from the piezoelectric element, and a frame attached to the second main surface of the supporter at a position between the first side wall and the second side wall while being spaced apart from the vibrator. In this structure, the diaphragm can be made of multiple materials.

A tenth aspect of the present disclosure provides the piezoelectric pump according to the ninth aspect, wherein an outer peripheral edge of the vibrator is disposed at a position different from a position serving as a vibration node of the vibrator. In this structure, the outer peripheral edge of the vibrator can reliably vibrate, so that vibrations of the piezoelectric element are prevented from being transmitted to side walls or top boards constituting the exterior of the piezoelectric pump. This structure can thus reduce vibration leakage, and increase displacement with the vibrator.

An eleventh aspect of the present disclosure provides the piezoelectric pump according to the ninth or tenth aspect, wherein the supporter is made of a material having a lower modulus of elasticity than the vibrator. Such a structure can reduce the leakage of the vibrations.

A twelfth aspect of the present disclosure provides the piezoelectric pump according to the eleventh aspect, wherein the supporter is thinner than the vibrator. Such a structure can reduce the leakage of the vibrations.

Hereinbelow, embodiments of the present disclosure will be described in detail with reference to the drawings.

First Embodiment

Figure 2:
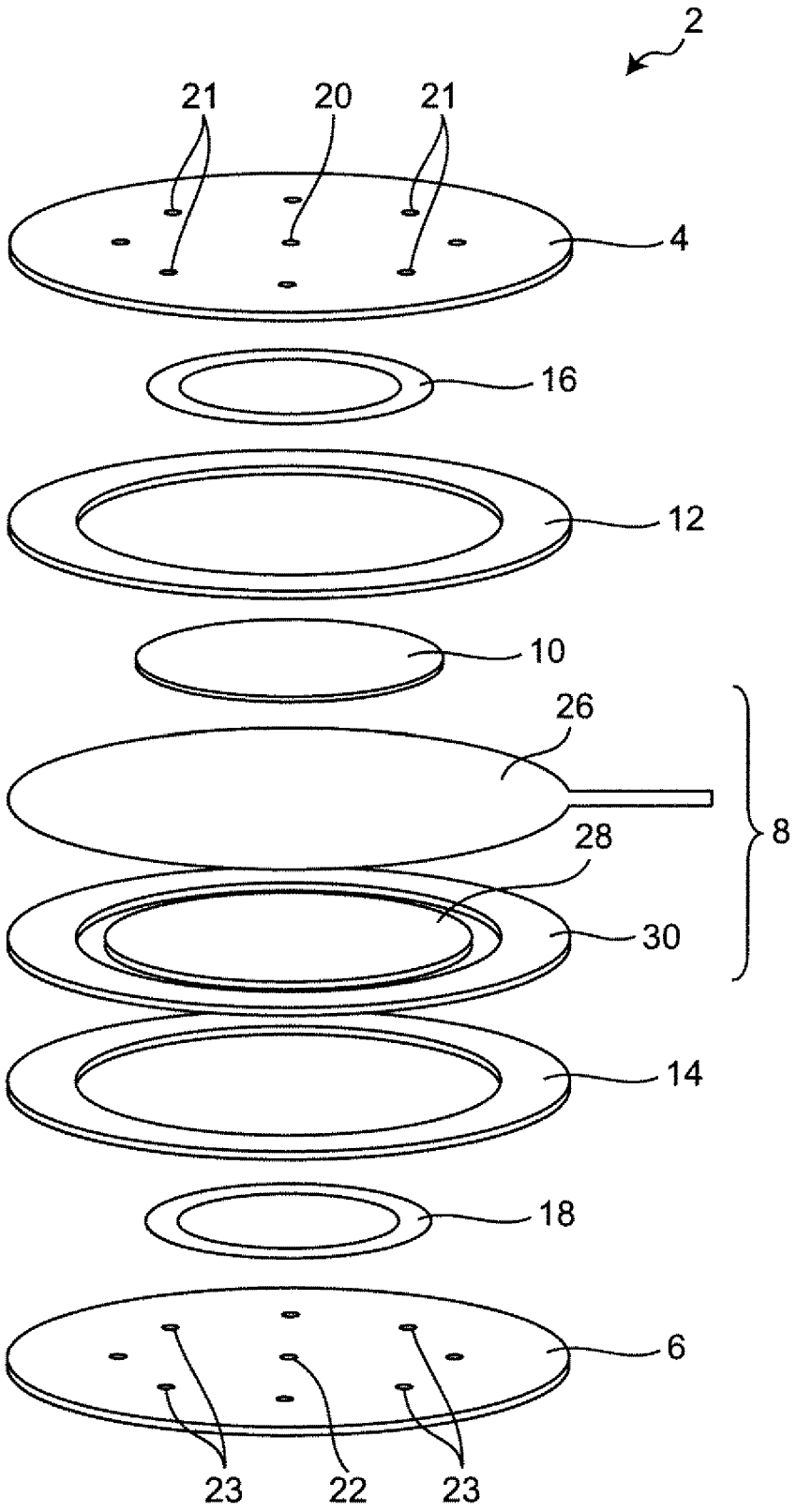
FIG. 2 is an exploded perspective view of the piezoelectric pump according to the first embodiment.
Figure 3:
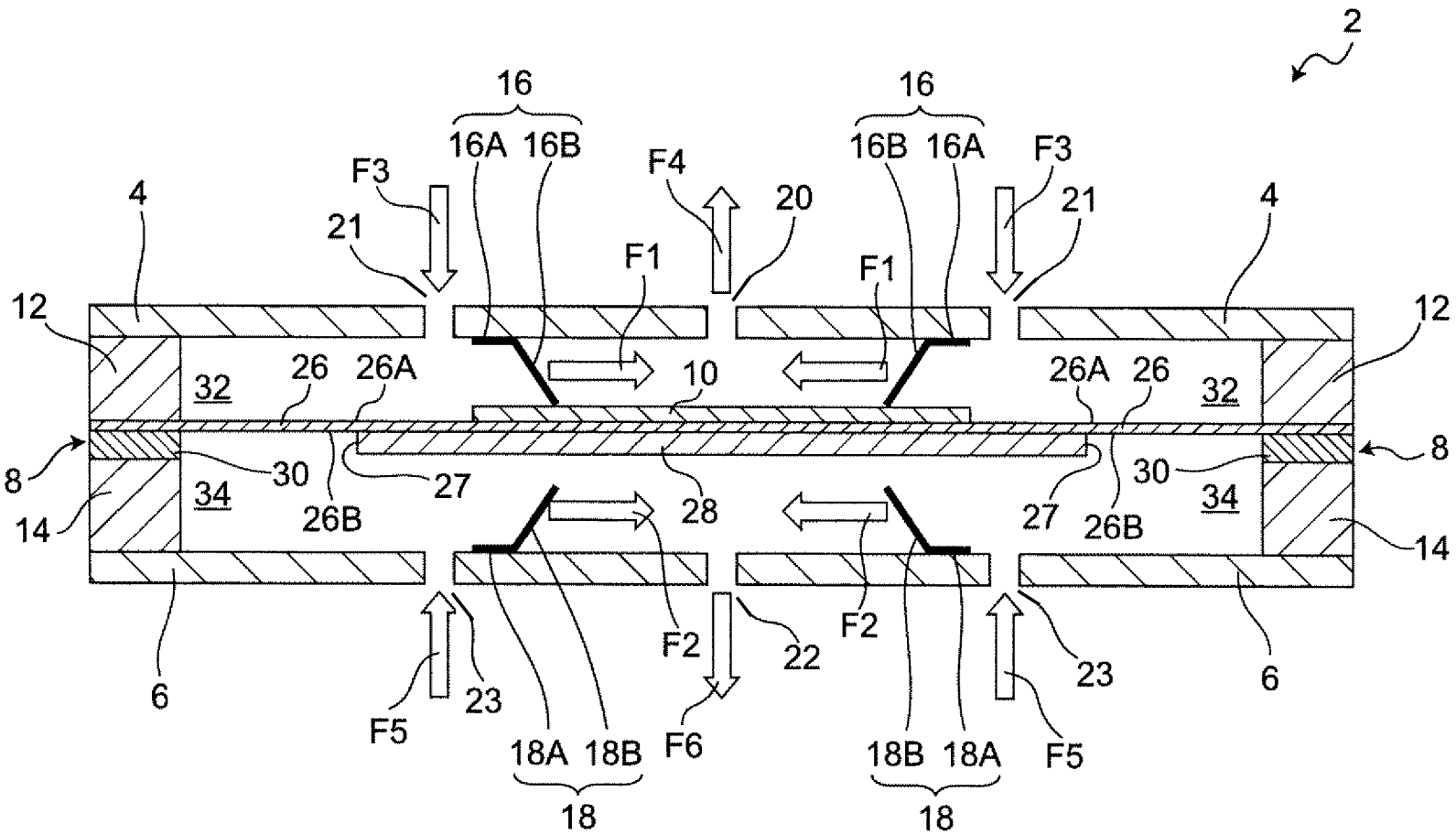
FIG. 3 is a cross-sectional view of the piezoelectric pump taken along line A-A in FIG. 1.

FIGS. 1 to 3 are views illustrating a schematic structure of a piezoelectric pump 2 according to a first embodiment. FIG. 1 is a perspective view of the piezoelectric pump 2 according to the first embodiment, FIG. 2 is an exploded perspective view of the piezoelectric pump 2, and FIG. 3 is a vertical cross-sectional view of the piezoelectric pump 2 (cross-sectional view taken along line A-A in FIG. 1).

The piezoelectric pump 2 is a pump device (may be also referred to as "Microblower" or "Micropump") that transports air using a piezoelectric element 10 (FIGS. 2 and 3). The piezoelectric pump 2 vibrates the piezoelectric element 10 at high speed to suck air through second apertures 21, serving as inlet ports, and to discharge air through a first aperture 20, serving as an outlet port. Similarly, the piezoelectric pump 2 is a pump that sucks air through fourth apertures 23, serving as inlet ports, and discharges air through a third aperture 22, serving as an outlet port.

As illustrated in FIGS. 2 and 3, the piezoelectric pump 2 includes a first top board 4, a second top board 6, a diaphragm 8, a piezoelectric element 10, a first side wall 12, a second side wall 14, a first valve 16, and a second valve 18. The piezoelectric pump 2 has a structure where the piezoelectric element 10 is bonded to the diaphragm 8. The piezoelectric element 10 causes unimorph bending deformation upon receiving AC power. The piezoelectric pump 2 includes, inside thereof, the first valve 16 and the second valve 18 serving as valves.

The first top board 4 and the second top board 6 respectively constitute a top surface and a rear surface of the piezoelectric pump 2. The first top board 4 and the second top board 6 are disk-shaped members, and spaced apart from each other. The first top board 4 and the second top board 6 are made of, for example, metal such as stainless steel, or resin such as polyphenylene sulfide (PPS).

The first top board 4 includes a first aperture 20 and second apertures 21. The first aperture 20 is disposed at the center portion of the first top board 4, and the multiple second apertures 21 are annularly arranged to surround the first aperture 20. In the first embodiment, the first aperture 20 functions as an outlet port, and the second apertures 21 function as inlet ports.

The second top board 6 includes a third aperture 22 and fourth apertures 23. The third aperture 22 is disposed at the center portion of the second top board 6, and the multiple fourth apertures 23 are annularly arranged to surround the third aperture 22. In the first embodiment, the third aperture 22 functions as an outlet port, and the fourth apertures 23 function as inlet ports.

The diaphragm 8 is a member disposed between the first top board 4 and the second top board 6. The piezoelectric element 10 is attached to the diaphragm 8. The diaphragm 8 includes a supporter 26, a vibrator 28, and a frame 30. In the first embodiment, the supporter 26, the vibrator 28, and the frame 30 are separate members.

The supporter 26 is a substantially disk-shaped member to which the piezoelectric element 10 is attached and that supports the piezoelectric element 10. The supporter 26 is made of an insulating material such as polyimide.

As illustrated in FIG. 3, the supporter 26 has a first main surface 26A and a second main surface 26B. The piezoelectric element 10 is attached to the first main surface 26A, and the vibrator 28 and the frame 30 are attached to the second main surface 26B.

The vibrator 28 is a disk-shaped member disposed across from the piezoelectric element 10. The vibrator 28 has a function of vibrating together with the piezoelectric element 10.

The frame 30 is an annular member forming an outer frame of the diaphragm 8. The frame 30 is disposed on the outer side of the vibrator 28 at a distance from the vibrator 28. The frame 30 is disposed to be held between the first side wall 12 and the second side wall 14. The frame 30 constitutes the side wall of the piezoelectric pump 2, together with the first side wall 12 and the second side wall 14.

The vibrator 28 and the frame 30 are made of metal such as stainless steel or aluminum.

The piezoelectric element 10 is located to overlap the vibrator 28 when viewed in a plan. As illustrated in FIG. 3, the piezoelectric element 10 is located to overlap the first aperture 20 and the first top board 4 around the first aperture 20 when viewed in a plan. Similarly, the piezoelectric element 10 is located to overlap the third aperture 22 and the second top board 6 around the third aperture 22 when viewed in a plan.

The first side wall 12 and the second side wall 14 constitute the side wall of the piezoelectric pump 2. The first side wall 12 and the second side wall 14 are annular members each having a circular opening at the center portion. The first side wall 12 and the second side wall 14 are made of, for example, metal or resin.

As illustrated in FIG. 3, the first side wall 12 couples the first top board 4 to the diaphragm 8 to define a first pump chamber 32 between the first top board 4 and the diaphragm 8. The second side wall 14 couples the second top board 6 to the diaphragm 8 to define a second pump chamber 34 between the second top board 6 and the diaphragm 8.

The first pump chamber 32 and the second pump chamber 34 are separated by the supporter 26 of the diaphragm 8. The supporter 26 according to the first embodiment separates the first pump chamber 32 from the second pump chamber 34 to disable connection between the first pump chamber 32 and the second pump chamber 34.

The first valve 16 and the second valve 18 are valves that control airflow inside the piezoelectric pump 2. The first valve 16 and the second valve 18 are annular members each having a circular opening at the center portion. The first valve 16 is disposed in the first pump chamber 32, and the second valve 18 is disposed in the second pump chamber 34. The first valve 16 and the second valve 18 are made of, for example, resin such as polyimide, PET, or PPS.

As illustrated in FIG. 3, the first valve 16 is disposed between the first aperture 20 and the second apertures 21 when viewed in a plan. Similarly, the second valve 18 is disposed between the third aperture 22 and the fourth apertures 23 when viewed in a plan.

As illustrated in FIG. 3, the first valve 16 includes a fixed portion (first fixed portion) 16A and a movable portion (first movable portion) 16B. The fixed portion 16A is a portion fixed to the first top board 4, and the movable portion 16B is a movable portion extending from the fixed portion 16A. The movable portion 16B functions as a free end (open end) without being fixed to any member.

The movable portion 16B is disposed closer to the first aperture 20 or the center portion than the fixed portion 16A is. This arrangement reduces airflow that flows outward from the center in the first pump chamber 32, and accelerates a reverse flow F1 that flows toward the center from the outer side.

Similarly, the second valve 18 includes a fixed portion (second fixed portion) 18A and a movable portion (second movable portion) 18B. The fixed portion 18A is a portion fixed to the second top board 6, and the movable portion 18B is a movable portion extending from the fixed portion 18A. The movable portion 18B functions as a free end without being fixed to any member.

The movable portion 18B is disposed closer to the third aperture 22 or the center portion than the fixed portion 18A is. This arrangement reduces airflow that flows outward from the center in the second pump chamber 34, and accelerates a reverse flow F2 that flows toward the center from the outer side.

The acceleration of the flow F1 in the first pump chamber 32 and the flow F2 in the second pump chamber 34 causes flows F3 to F6, as illustrated in FIG. 3. The flow F3 is air that flows into the first pump chamber 32 from the outer side of the piezoelectric pump 2 through the second apertures 21. The flow F4 is air that flows out of the first pump chamber 32 to the outer side of the piezoelectric pump 2 through the first aperture 20. Similarly, the flow F5 is air that flows into the second pump chamber 34 from the outer side of the piezoelectric pump 2 through the fourth apertures 23. The flow F6 is air that flows out of the second pump chamber 34 to the outer side of the piezoelectric pump 2 through the third aperture 22. FIG. 3 illustrates the flows F1 to F6 with arrows as general flows inside the piezoelectric pump 2.

Figure 4:
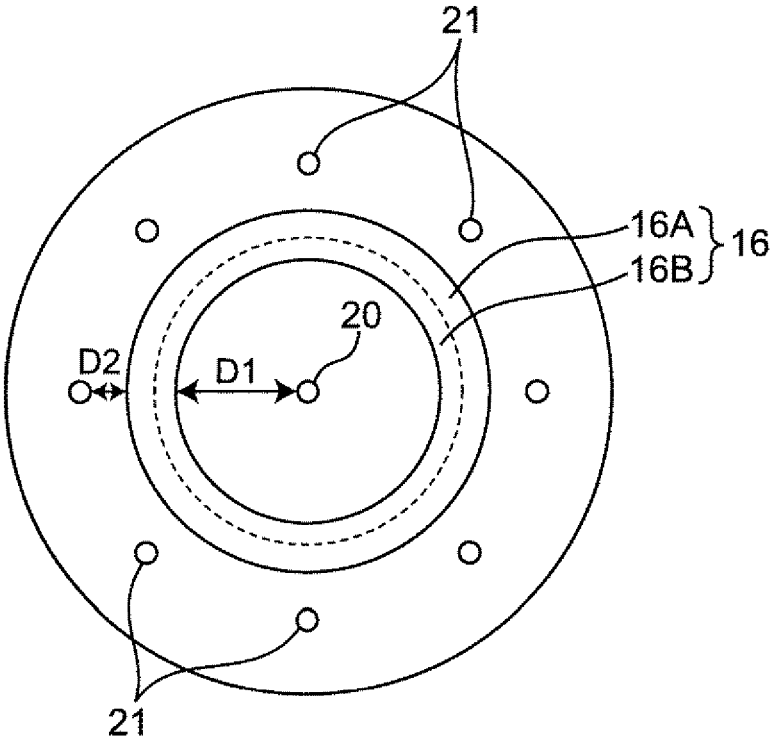
FIG. 4 is a plan view of the piezoelectric pump according to the first embodiment illustrating the positional relationship between a first aperture, second apertures, and a first valve.
Figure 5:
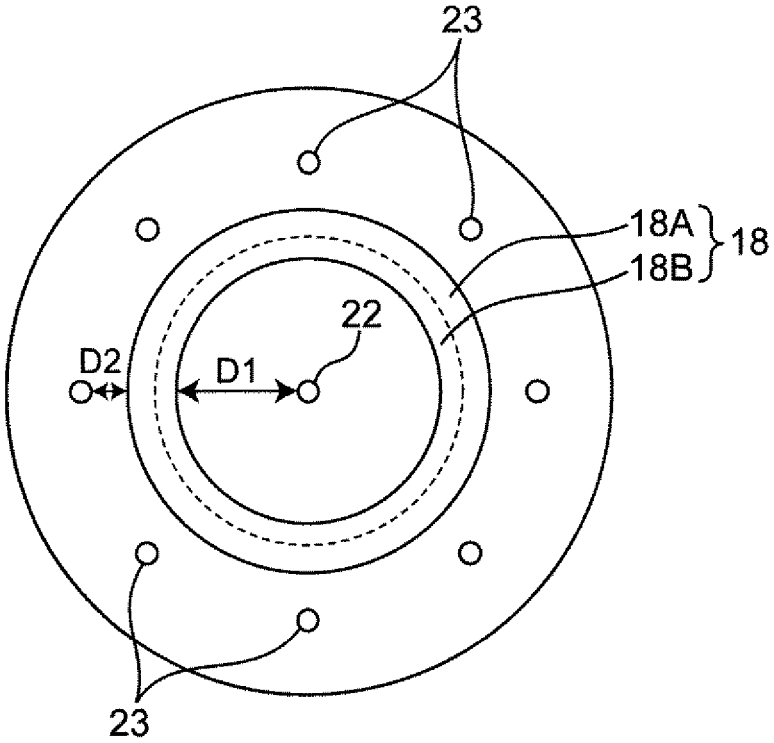
FIG. 5 is a plan view of the piezoelectric pump according to the first embodiment illustrating the positional relationship between a third aperture, fourth apertures, and a second valve.

With reference to FIGS. 4 and 5, the relationship between the first valve 16 and the apertures 20 and 21 and the relationship between the second valve 18 and the apertures 22 and 23 will be described. FIG. 4 is a plan view of the piezoelectric pump 2 illustrating the positional relationship between the first aperture 20, the second apertures 21, and the first valve 16. FIG. 5 is a plan view of the piezoelectric pump 2 illustrating the positional relationship between the third aperture 22, the fourth apertures 23, and the second valve 18.

As illustrated in FIG. 4, the first aperture 20 is disposed on the inner side of the first valve 16 when viewed in a plan, and the second apertures 21 are disposed on the outer side of the first valve 16 when viewed in a plan. The first valve 16 has an annular shape to surround the first aperture 20 at a distance D1 from the first aperture 20. The first valve 16 is also spaced apart at a distance D2 from the second apertures 21. In this structure, the first valve 16 is spaced apart from the first aperture 20 and the second apertures 21. Thus, even when the movable portion 16B of the first valve 16 moves at high speed while the piezoelectric pump 2 is being driven, the movable portion 16B is prevented from colliding against the edge of the first aperture 20 and the edges of the second apertures 21. This structure where the movable portion 16B of the first valve 16 is prevented from colliding against the edges of the apertures 20 and 21 can reduce the damages on the first valve 16, and extend the life of the first valve 16. Thus, the reliability of the piezoelectric pump 2 can be improved.

Similarly, as illustrated in FIG. 5, the third aperture 22 is disposed on the inner side of the second valve 18 when viewed in a plan, and the fourth apertures 23 are disposed on the outer side of the second valve 18 when viewed in a plan. The second valve 18 has an annular shape to surround the third aperture 22 at the distance D1 from the third aperture 22. The second valve 18 is also spaced apart at the distance D2 from the fourth apertures 23. In this structure, as in the first valve 16, the movable portion 18B of the second valve 18 is prevented from colliding against the edge of the third aperture 22 and the edges of the fourth apertures 23. This structure can reduce the damages on the second valve 18, and extend the life of the second valve 18. Thus, the reliability of the piezoelectric pump 2 can be improved.

Referring back to FIG. 3, the first aperture 20 is disposed on the inner side of an outer peripheral edge 27 of the vibrator 28 when viewed in a plan, and the third aperture 22 is disposed on the inner side of the outer peripheral edge 27 of the vibrator 28 when viewed in a plan. Vibrations of the vibrator 28 change the pressure around the first aperture 20 and the third aperture 22, and increase the flow rate of a fluid that flows out from the first pump chamber 32 and the second pump chamber 34 in response to the vibrations of the vibrator 28.

The second apertures 21 are disposed on the inner side of the outer peripheral edge 27 of the vibrator 28 when viewed in a plan, and the fourth apertures 23 are disposed on the inner side of the outer peripheral edge 27 of the vibrator 28 when viewed in a plan. Vibrations of the vibrator 28 change the pressure around the second apertures 21 and the fourth apertures 23, and increase the flow rate of a fluid that flows into the first pump chamber 32 and the second pump chamber 34 in response to the vibrations of the vibrator 28.

Figure 6:
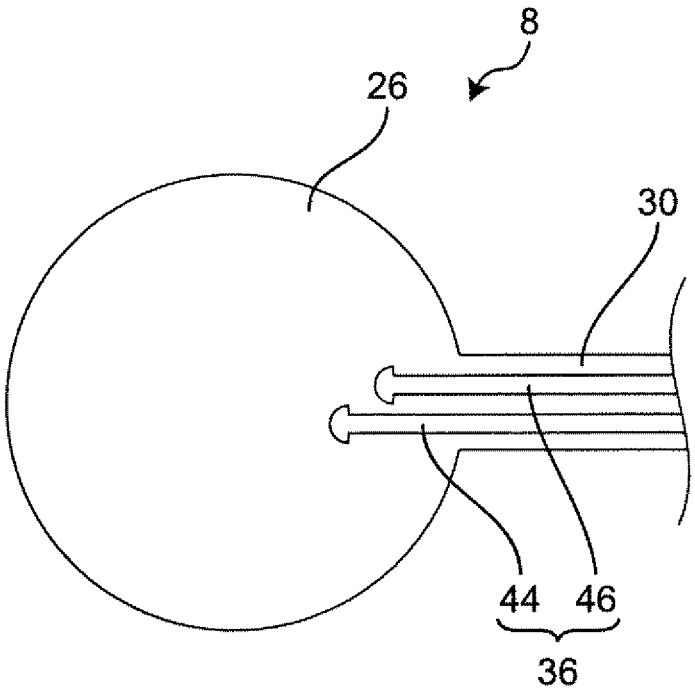
FIG. 6 is a plan view of the top surface of the diaphragm according to the first embodiment.
Figure 7:
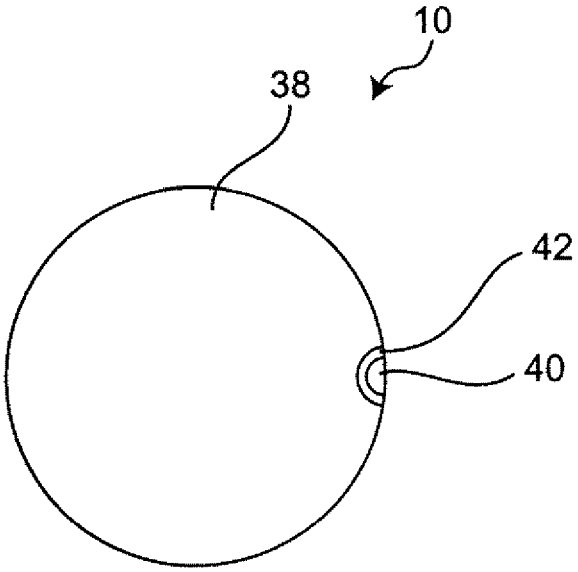
FIG. 7 is a plan view of the rear surface of the piezoelectric element according to the first embodiment.

Wires 36 connected to the piezoelectric element 10 will now be described with reference to FIGS. 6 and 7. FIG. 6 is a plan view of the top surface of the supporter 26 in the diaphragm 8 on which the wires 36 are disposed. FIG. 7 is a plan view of the rear surface of the piezoelectric element 10.

As illustrated in FIG. 6, a first wire 44 and a second wire 46, included in the wires 36, are disposed on the top surface of the supporter 26. As described above, the supporter 26 itself is made of an insulating material, and the first wire 44 and the second wire 46 disposed on the supporter 26 are electrically insulated from each other. The first wire 44 and the second wire 46 disposed on the supporter 26 made of an insulating material can reduce the risk of disconnection.

The first wire 44 and the second wire 46 are connected to a driving circuit (not illustrated) disposed outside of the piezoelectric pump 2.

Although not illustrated, a portion where the first wire 44 and the second wire 46 are in contact with the first side wall 12 and the second side wall 14 is coated with an insulating material to avoid electrical connection with the side walls 12 and 14.

As illustrated in FIG. 7, a first electrode 38 and a second electrode 40 are formed on the rear surface of the piezoelectric element 10. An insulating region 42 is disposed between the first electrode 38 and the second electrode 40 to electrically insulate the first electrode 38 from the second electrode 40. The first electrode 38 is disposed on most part of the rear surface of the piezoelectric element 10, and the second electrode 40 is disposed on a small portion of the rear surface of the piezoelectric element 10. The second electrode 40 is disposed on the entirety of the top surface (not illustrated) of the piezoelectric element 10. FIG. 7 illustrates a portion of the second electrode 40 folded back to the rear surface.

To place the rear surface of the piezoelectric element 10 illustrated in FIG. 7 on the supporter 26 of the diaphragm 8 illustrated in FIG. 6, the first electrode 38 is brought into contact with the first wire 44 and, concurrently, the second electrode 40 is brought into contact with the second wire 46. AC power can be fed to the first electrode 38 and the second electrode 40 through two wires, that is, the first wire 44 and the second wire 46, respectively. Thus, this structure can cause the piezoelectric element 10 to perform desired bending movement.

The operation of the piezoelectric pump 2 with the above structure will be described with reference to FIG. 8A to FIG. 8D. FIG. 8A to FIG. 8D are vertical cross-sectional views illustrating the piezoelectric pump 2 in the respective states when being driven. FIG. 8A to FIG. 8D illustrate the diaphragm 8 in a simplified manner.

Figure 8A:
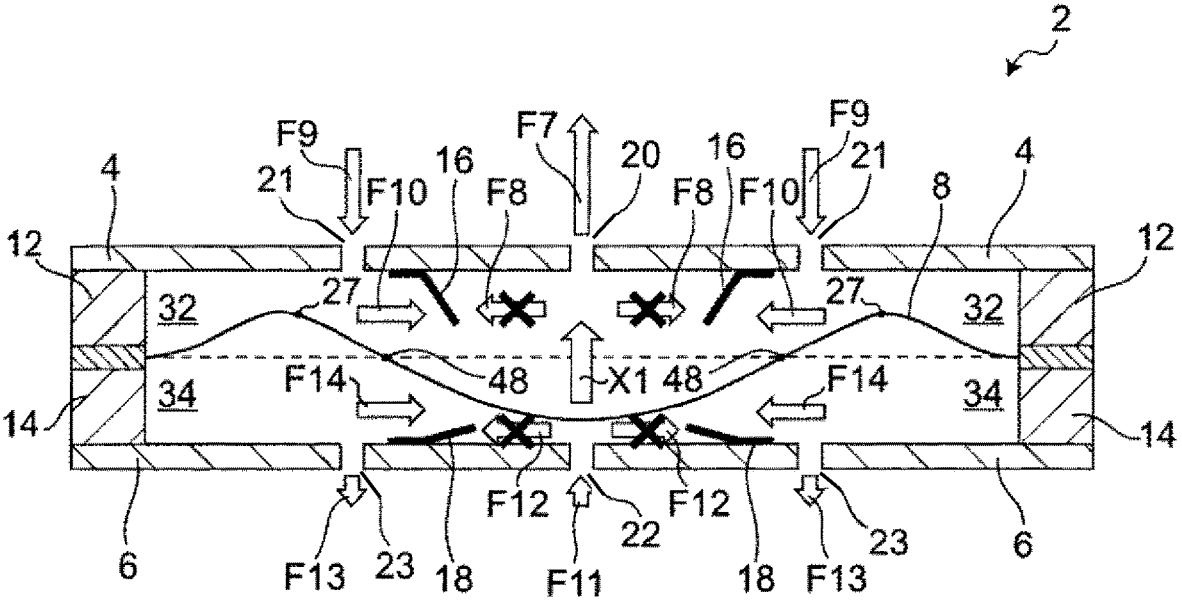
FIG. 8A is a cross-sectional view of the piezoelectric pump according to the first embodiment in a driven state.
Figure 8B:
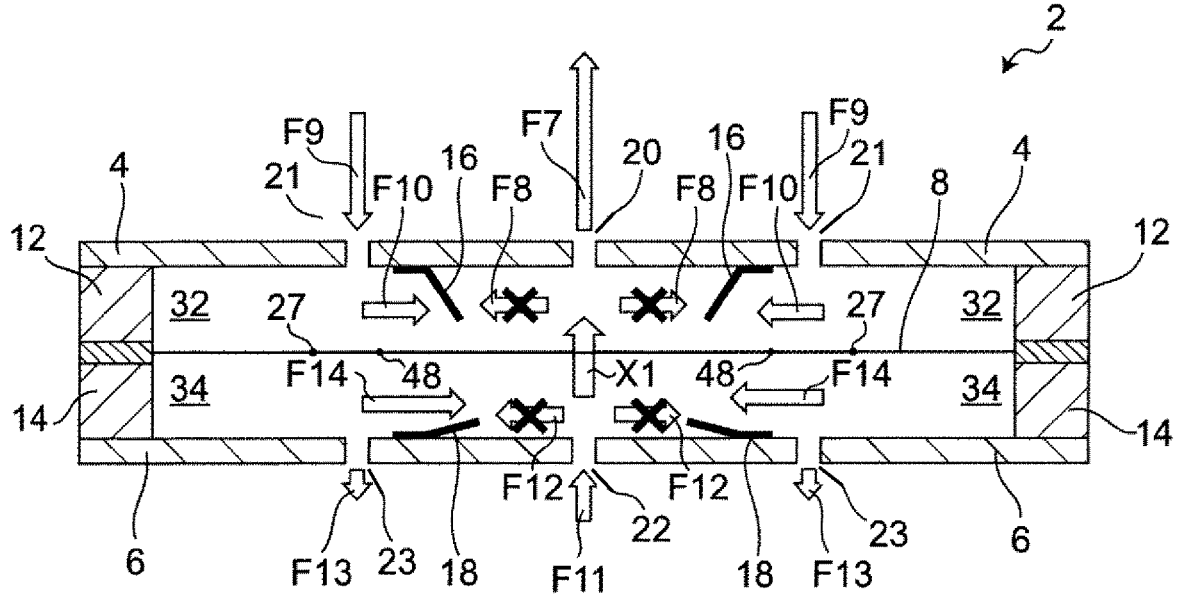
FIG. 8B is a cross-sectional view of the piezoelectric pump according to the first embodiment in a driven state.

FIG. 8A illustrates the state where the center portion of the diaphragm 8 is recessed at maximum toward the second top board 6. FIG. 8B illustrates the state where the center portion of the diaphragm 8 is moved toward the first top board 4 from the state illustrated in FIG. 8A to flatten.

As illustrated in FIGS. 8A and 8B, when the center portion of the diaphragm 8 moves from the second top board 6 toward the first top board 4 (arrow X1), air at the center portion of the first pump chamber 32 is pushed toward the first top board 4 to cause a flow F7 discharged from the first aperture 20. Here, a flow F8 of air that flows outward from the center portion of the first pump chamber 32 is blocked by the first valve 16. Thus, the flow F7 has a relatively high flow rate.

On the other hand, the space on the outer side in the first pump chamber 32 extends to the lower side, and thus causes a negative pressure. This negative pressure causes a flow F9, which flows into the first pump chamber 32 from the outside of the piezoelectric pump 2 through the second apertures 21. Here, a flow F10 of air that flows from the outer side in the first pump chamber 32 toward the center portion is prevented from being blocked by the first valve 16.

The space in the second pump chamber 34 at the center portion extends to the upper side, and thus causes a negative pressure. This negative pressure causes a flow F11 that flows into the second pump chamber 34 from the outside of the piezoelectric pump 2 through the third aperture 22. Here, a flow F12 of air that flows outward from the center portion of the second pump chamber 34 is blocked by the second valve 18. Thus, the flow F11 has a relatively low flow rate.

On the other hand, the space on the outer side in the second pump chamber 34 is narrowed, and increases the pressure. This high pressure causes a flow F13 that flows out of the piezoelectric pump 2 from the second pump chamber 34 through the fourth apertures 23. Here, concurrently, a flow F14 of air that flows from the outer side in the second pump chamber 34 toward the center portion occurs. The flow F14 is prevented from being blocked by the second valve 18. The second pump chamber 34 through which the flow F14 flows has a flow-path cross section larger than a flow-path cross section of the fourth apertures 23 through which the flow F13 flows. Thus, the flow F13 has a smaller flow rate than the flow rate of the flow F14.

Figure 8C:
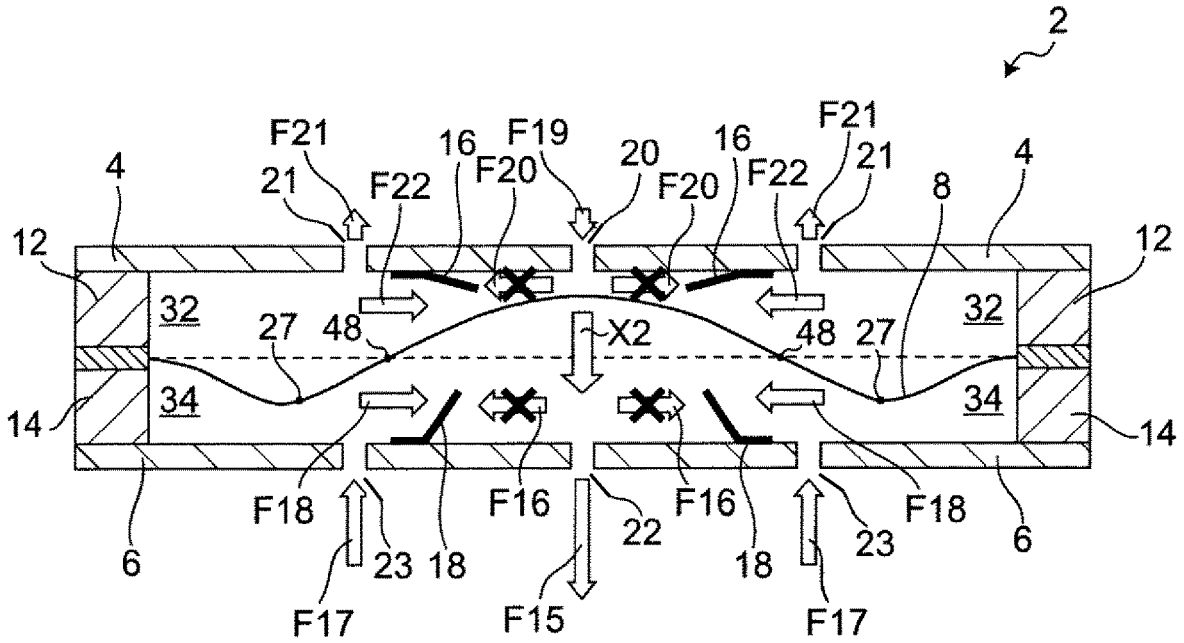
FIG. 8C is a cross-sectional view of the piezoelectric pump according to the first embodiment in a driven state.
Figure 8D:
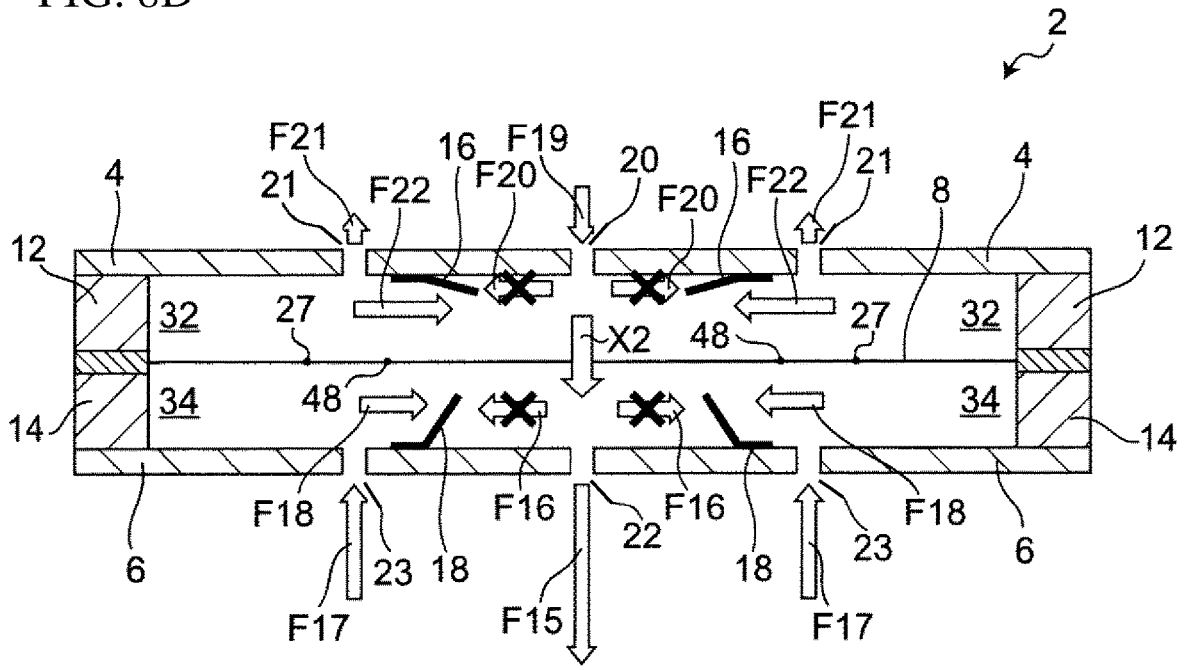
FIG. 8D is a cross-sectional view of the piezoelectric pump according to the first embodiment in a driven state.

FIGS. 8C and 8D illustrate the states following the state illustrated in FIG. 8B. FIG. 8C illustrates the state where the center portion of the diaphragm 8 is moved at maximum toward the first top board 4 from the state illustrated in FIG. 8B. FIG. 8D illustrates the state where the center portion of the diaphragm 8 is moved from the state illustrated in FIG. 8C toward the second top board 6 to flatten.

As illustrated in FIGS. 8C and 8D, when the center portion of the diaphragm 8 moves from the first top board 4 toward the second top board 6 (arrow X2), air at the center portion of the second pump chamber 34 is pushed toward the second top board 6 to cause a flow F15 discharged to the outside from the third aperture 22. Here, a flow F16 of air that flows outward from the center portion of the second pump chamber 34 is blocked by the second valve 18. Thus, the flow F15 has a relatively high flow rate.

On the other hand, the space on the outer side in the second pump chamber 34 extends to the upper side, and thus causes a negative pressure. This negative pressure causes a flow F17, which flows into the second pump chamber 34 from the outside of the piezoelectric pump 2 through the fourth apertures 23. Here, a flow F18 of air that flows from the outer side in the second pump chamber 34 toward the center portion is prevented from being blocked by the second valve 18.

The space in the first pump chamber 32 at the center portion extends to the lower side, and thus causes a negative pressure. This negative pressure causes a flow F19 that flows into the first pump chamber 32 from the outside of the piezoelectric pump 2 through the first aperture 20. Here, a flow F20 of air that flows outward from the center portion of the first pump chamber 32 is blocked. Thus, the flow F19 has a relatively low flow rate.

On the other hand, the space on the outer side in the first pump chamber 32 is narrowed, and increases the pressure. This high pressure causes a flow F21 that flows out of the piezoelectric pump 2 through the second apertures 21. Here, concurrently, a flow F22 of air that flows from the outer side in the first pump chamber 32 toward the center portion occurs. The flow F22 is prevented from being blocked by the first valve 16. The first pump chamber 32 through which the flow F22 flows has a flow-path cross section larger than a flow-path cross section of the second apertures 21 through which the flow F21 flows. Thus, the flow F21 has a smaller flow rate than the flow rate of the flow F22.

The sequential states illustrated in FIG. 8A to FIG. 8D are repeated at high speed in accordance with vibration cycles of the piezoelectric element 10. Here, with the airflow control effect of the first valve 16, the flow rates of the flows F7 and F9 illustrated in FIGS. 8A and 8B are higher than the flow rates of the flows F19 and F21 illustrated in FIGS. 8C and 8D. Similarly, with the airflow control effect of the second valve 18, the flow rates of the flows F11 and F13 illustrated in FIGS. 8A and 8B are lower than the flow rates of the flows F15 and F17 illustrated in FIGS. 8C and 8D. The flows F1 to F6 illustrated in FIG. 3 generally occur inside the piezoelectric pump 2. Specifically, in the first pump chamber 32, the flows F3, F1, and F4 of air that flows from the outside of the piezoelectric pump 2 into the first pump chamber 32 through the second apertures 21 and then flows out through the first aperture 20 generally occur. Similarly, in the second pump chamber 34, the flows F5, F2, and F6 of air that flows from the outside of the piezoelectric pump 2 into the second pump chamber 34 through the fourth apertures 23 and then flows out through the third aperture 22 generally occur.

As illustrated in FIG. 8A to FIG. 8D, the diaphragm 8 has a vibration node 48. The vibration node 48 is a portion that is not displaced with vibrations of the vibrator 28 in the diaphragm 8. On the other hand, the outer peripheral edge 27 of the vibrator 28 is not located at the vibration node 48. This arrangement allows the outer peripheral edge 27 of the vibrator 28 to reliably vibrate, and prevents vibrations of the vibrator 28 from being transmitted to the side walls 12 and 14 through the supporter 26. This arrangement can thus prevent the leakage of the vibrations of the piezoelectric element 10.

In the piezoelectric pump 2 according to the first embodiment, the first valve 16 is spaced apart from the first aperture 20 and the second apertures 21 when viewed in a plan, and the second valve 18 is spaced apart from the third aperture 22 and the fourth apertures 23 when viewed in a plan. In this arrangement, the first valve 16 and the second valve 18 are spaced apart from the respective apertures, and thus prevented from colliding against the edges of the apertures. This structure can thus prevent the damages on the valves 16 and 18. This structure can thus extend the lives of the valves 16 and 18, and improve the reliability of the piezoelectric pump 2.

In the piezoelectric pump 2 according to the first embodiment, the first valve 16 includes the first fixed portion 16A fixed to the first top board 4, and the first movable portion 16B extending from the first fixed portion 16A. The second valve 18 includes the second fixed portion 18A fixed to the second top board 6, and the second movable portion 18B extending from the second fixed portion 18A. Compared to the case where the valves 16 and 18 are fixed to the diaphragm 8, this structure where the valves 16 and 18 are respectively fixed to the top boards 4 and 6 can further reduce the vibrations of the first fixed portion 16A of the valve 16 and the second fixed portion 18A of the valve 18. This structure can thus reduce excessive vibration loss, and achieve large vibration displacement, a high flow rate, and high pressure characteristics.

In the piezoelectric pump 2 according to the first embodiment, the first movable portion 16B of the first valve 16 is disposed on the inner side of the first fixed portion 16A of the first valve 16 when viewed in a plan, and the second movable portion 18B of the second valve 18 is disposed on the inner side of the second fixed portion 18A of the second valve 18 when viewed in a plan. In this structure, the first valve 16 and the second valve 18 reduce outward airflow and accelerate inward airflow when viewed in a plan, to cause the flows F1 to F6 illustrated in FIG. 3 as general flows.

In the piezoelectric pump 2 according to the first embodiment, the diaphragm 8 includes the supporter 26, the vibrator 28, and the frame 30. In this structure, the supporter 26, the vibrator 28, and the frame 30 constituting the diaphragm 8 are formed from separate members, and thus the diaphragm 8 can be made of multiple materials. This structure can expand the range of material and shape options.

In the first embodiment, the supporter 26 is made of a material with a lower modulus of elasticity than the vibrator 28. This structure can reduce the vibrations of the vibrator 28 transmitted to the side walls 12 and 14 through the supporter 26, and thus can reduce the leakage of the vibrations.

In the first embodiment, the supporter 26 is thinner than the vibrator 28. This structure can reduce the vibrations of the vibrator 28 transmitted to the side walls 12 and 14 through the supporter 26, and thus can further reduce the leakage of the vibrations.

Second and Third Embodiments

A piezoelectric pump according to each of second and third embodiments of the present disclosure will be described. The second and third embodiments will be mainly described in terms of points different from those of the first embodiment. The description that repeats the description for the first embodiment will be omitted.

Figure 9:
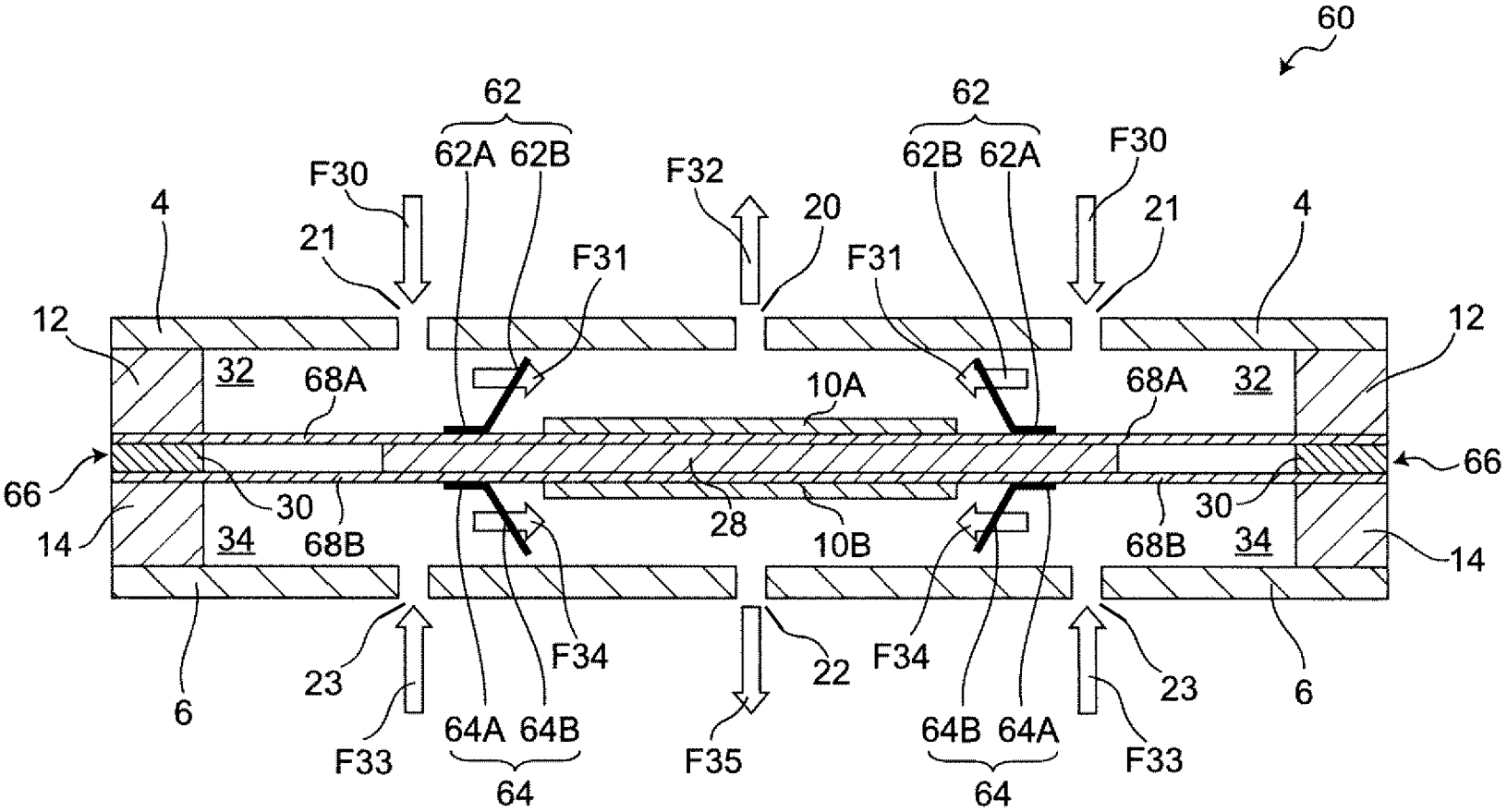
FIG. 9 is a cross-sectional view of a schematic structure of a piezoelectric pump according to a second embodiment.
Figure 10:
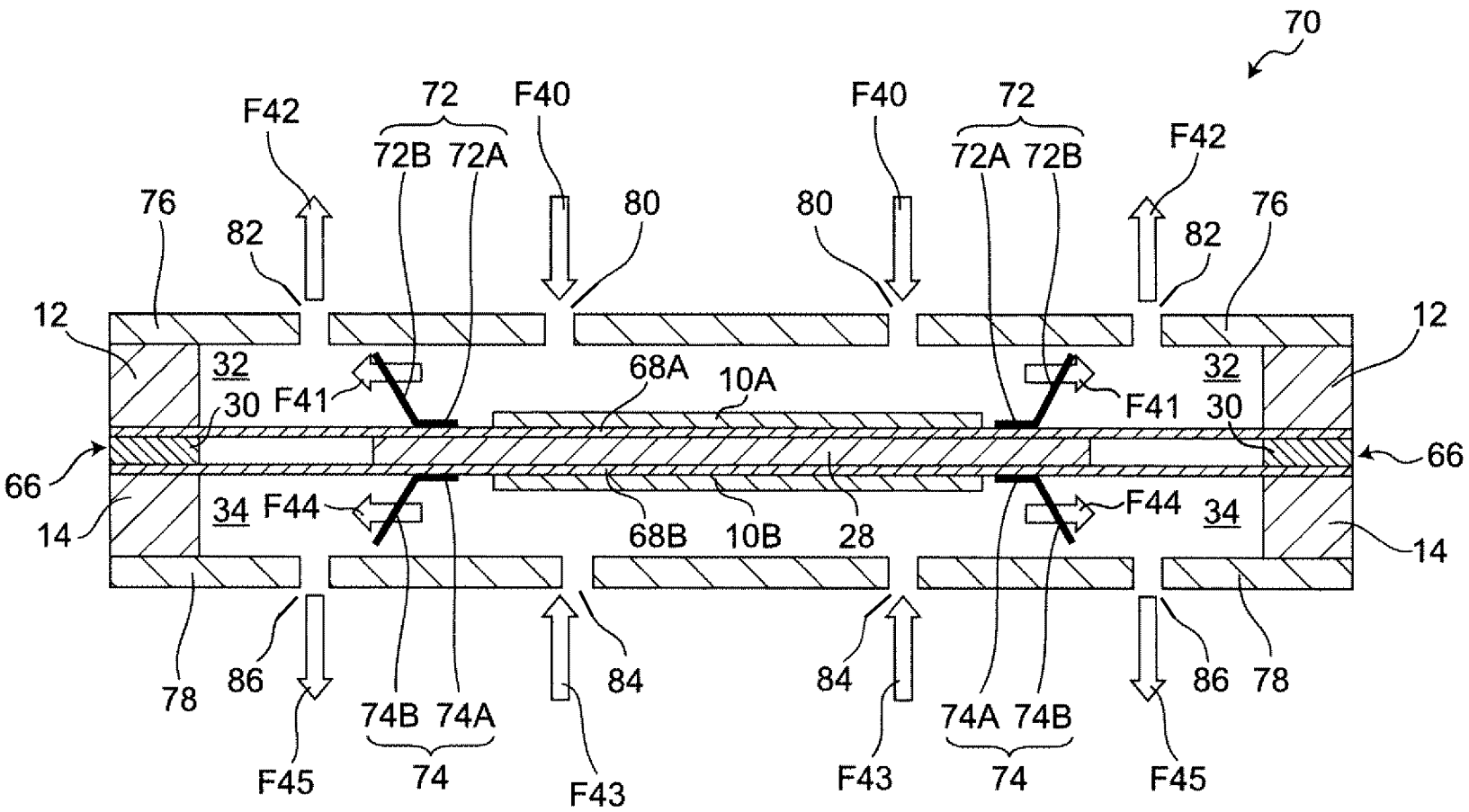
FIG. 10 is a cross-sectional view of a schematic structure of a piezoelectric pump according to a third embodiment.

FIG. 9 is a vertical cross-sectional view of a schematic structure of a piezoelectric pump 60 according to a second embodiment. FIG. 10 is a vertical cross-sectional view of a schematic structure of a piezoelectric pump 70 according to a third embodiment.

The second and third embodiments are different from the first embodiment in terms of, for example, the position or orientation of the first valve disposed in the first pump chamber 32, the position or orientation of the second valve disposed in the second pump chamber 34, the number of the piezoelectric elements, and the structure of the diaphragm.

Second Embodiment

As illustrated in FIG. 9, a piezoelectric pump 60 according to the second embodiment includes a first valve 62 and a second valve 64. Unlike in the first embodiment, the first valve 62 and the second valve 64 are fixed to a diaphragm 66. In the second embodiment, the diaphragm 66 also includes two supporters 68A and 68B, which vertically hold the vibrator 28 and the frame 30 therebetween. A piezoelectric element 10A is attached to the supporter 68A, and a piezoelectric element 10B is bonded to the supporter 68B.

As illustrated in FIG. 9, the first valve 62 is fixed to the top surface of the supporter 68A, and the second valve 64 is fixed to the rear surface of the supporter 68B. The first valve 62 is fixed to the area of the top surface of the supporter 68A where the piezoelectric element 10A is not attached, and the second valve 64 is fixed to the area of the top surface of the supporter 68B where the piezoelectric element 10B is not attached.

As illustrated in FIG. 9, the first valve 62 includes a third fixed portion 62A and a third movable portion 62B, and the third movable portion 62B is disposed on the inner side of the third fixed portion 62A when viewed in a plan. Similarly, the second valve 64 includes a fourth fixed portion 64A and a fourth movable portion 64B, and the fourth movable portion 64B is disposed on the inner side of the fourth fixed portion 64A when viewed in a plan. In such a structure, flows similar to those in the piezoelectric pump 2 according to the first embodiment occur. Specifically, in the first pump chamber 32, flows F30 to F32 of air that flows in from the outside of the piezoelectric pump 60 through the second apertures 21 and then flows out through the first aperture 20 occur generally. Similarly, in the second pump chamber 34, flows F33 to F35 of air that flows in from the outside of the piezoelectric pump 60 through the fourth apertures 23 and then flows out through the third aperture 22 occur generally.

Fixing the valves 62 and 64 to the diaphragm 66 enables the reduction of the flow path resistance near the top boards 4 and 6 in the internal space of the piezoelectric pump 60, and acquirement of a high flow rate.

Providing the two piezoelectric elements 10A and 10B increases the displacement of the piezoelectric elements 10A and 10B, and improves the characteristics compared to the structure including only one piezoelectric element 10. The piezoelectric elements 10A and 10B and the diaphragm 8 form a vertically symmetrical shape. This structure at least partially prevents the warpage of the diaphragm 8 in response to a temperature change, and has stable characteristics.

Third Embodiment

As illustrated in FIG. 10, the piezoelectric pump 70 according to the third embodiment includes a first valve 72 and a second valve 74. As with the second embodiment, the first valve 72 and the second valve 74 are respectively fixed to the supporters 68A and 68B of the diaphragm 66, but the positional relationship between the movable portion and the fixed portion in the valves 72 and 74 is different from that in the second embodiment. In addition, the positional relationship between first apertures 80 and second apertures 82 formed in a first top board 76 and the positional relationship between third apertures 84 and fourth apertures 86 formed in a second top board 78 are also different from those in the second embodiment.

As illustrated in FIG. 10, the first valve 72 includes a third fixed portion 72A and a third movable portion 72B, and the third movable portion 72B is disposed on the outer side of the third fixed portion 72A when viewed in a plan. Similarly, the second valve 74 includes a fourth fixed portion 74A and a fourth movable portion 74B, and the fourth movable portion 74B is disposed on the outer side of the fourth fixed portion 74A when viewed in a plan. The first valve 72 and the second valve 74 block inward airflow when viewed in a plan. As illustrated in FIG. 10, in this structure, reverse flows F40 to F42 and F43 to F45, which flow in the directions opposite to those in the first and second embodiments, occur generally. Specifically, in the first pump chamber 32, flows F40 to F42 of air that flow from the outside of the piezoelectric pump 70 into the first pump chamber 32 through the first apertures 80 and then flows out through the second apertures 82 can occur generally. Similarly, in the second pump chamber 34, flows F43 to F45 of air that flows from the outside of the piezoelectric pump 70 into the second pump chamber 34 through the third apertures 84 and then flows out through the fourth apertures 86 can occur generally.

Figure 11A:
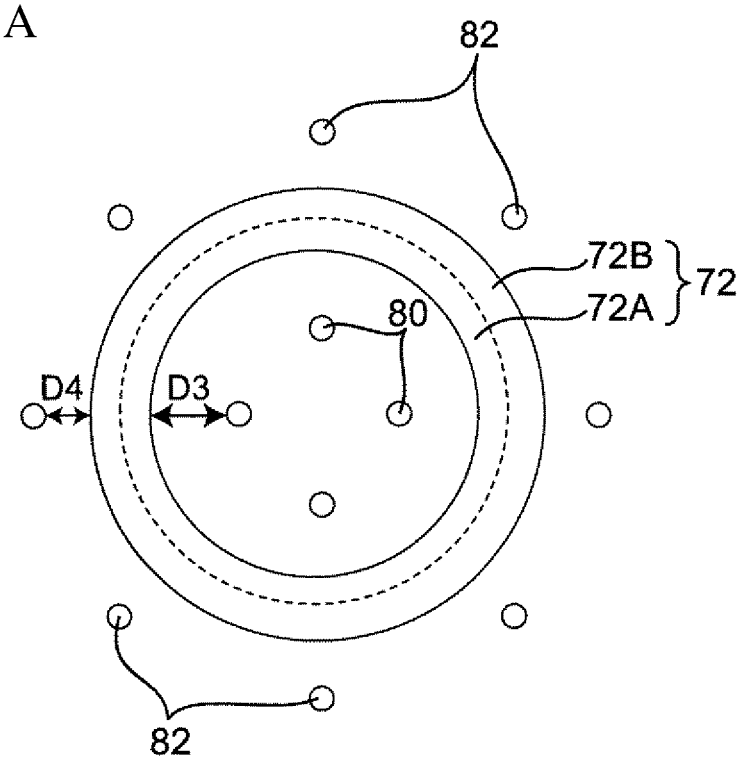
FIG. 11A is a plan view of the piezoelectric pump according to the third embodiment illustrating the positional relationship between first apertures, second apertures, and a first valve.
Figure 11B:
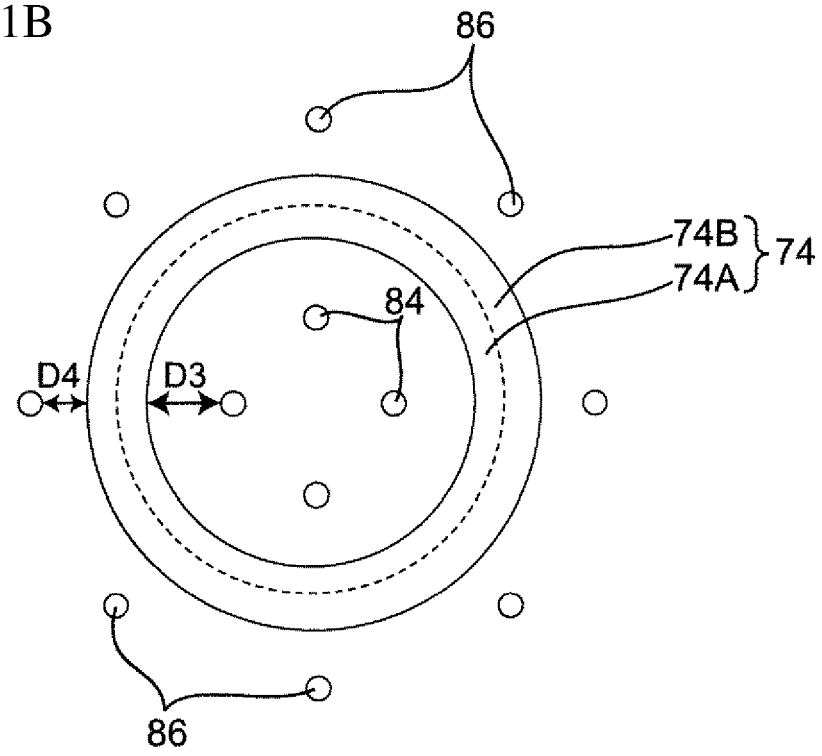
FIG. 11B is a plan view of the piezoelectric pump according to the third embodiment illustrating the positional relationship between third apertures, fourth apertures, and a second valve.

With reference to FIGS. 11A and 11B, the relationship between the valves and the apertures in the piezoelectric pump 70 according to the third embodiment will be described.

FIG. 11A is a plan view of the piezoelectric pump 70 illustrating the positional relationship between the first apertures 80, the second apertures 82, and the first valve 72. FIG. 11B is a plan view of the piezoelectric pump 70 illustrating the positional relationship between the third apertures 84, the fourth apertures 86, and the second valve 74.

As illustrated in FIG. 11A, the first apertures 80 and the second apertures 82 are multiple apertures. The multiple first apertures 80 and the multiple second apertures 82 are arranged in circles when viewed in a plan. The multiple first apertures 80 are arranged on the inner side of the first valve 72, and the multiple second apertures 82 are arranged on the outer side of the first valve 72. Specifically, the diameter of the circumference on which the first apertures 80 are arranged is smaller than the diameter of the circumference on which the second apertures 82 are arranged. In this arrangement, the first valve 72 is disposed between the first apertures 80 and the second apertures 82 when viewed in a plan, to have an annular shape surrounding the first apertures 80 while being spaced at a distance D3 from the first apertures 80 and a distance D4 from the second apertures 82.

This arrangement where the first valve 72 is spaced at the distances D3 and D4 from the first apertures 80 and the second apertures 82 can prevent the first valve 72 from colliding against the edges of the apertures 80 and 82. This structure can thus reduce the damages on the first valve 72, extend the life of the first valve 72, and improve the reliability of the piezoelectric pump 70.

Similarly, as illustrated in FIG. 11B, the third apertures 84 and the fourth apertures 86 are multiple apertures. The multiple third apertures 84 and the multiple fourth apertures 86 are arranged in circles when viewed in a plan. The multiple third apertures 84 are arranged on the inner side of the second valve 74, and the multiple fourth apertures 86 are arranged on the outer side of the second valve 74. Specifically, the diameter of the circumference on which the third apertures 84 are arranged is smaller than the diameter of the circumference on which the fourth apertures 86 are arranged. In this arrangement, the second valve 74 is disposed between the third apertures 84 and the fourth apertures 86 when viewed in a plan, to have an annular shape surrounding the third apertures 84 while being spaced at the distance D3 from the third apertures 84 and the distance D4 from the fourth apertures 86.

This arrangement where the second valve 74 is spaced at the distances D3 and D4 from the third apertures 84 and the fourth apertures 86 can prevent the second valve 74 from colliding against the edges of the apertures 84 and 86. This structure can thus reduce the damages on the second valve 74, extend the life of the second valve 74, and improve the reliability of the piezoelectric pump 70.

This structure where the apertures 80, 82, 84, and 86 formed from multiple apertures can reduce the flow path resistance at each aperture, and achieve a high flow rate.

The present disclosure has been described thus far using the first to third embodiments as examples. However, the present disclosure is not limited to the first to third embodiments. Although the supporter 26, the vibrator 28, and the frame 30 constituting the diaphragm 8 according to the first embodiment are described as being separate members, this is not the only possible structure. For example, the diaphragm 8 may be a single integrated body.

The present disclosure has been fully described in relation to preferable embodiments with reference to the appended drawings. However, various changes or modifications are apparent to persons having ordinary skill in the art. It should be understood that such changes or modifications are included in the scope of the present disclosure defined by the appended scope of claims without departing from the scope of the disclosure. Any combination of components between different embodiments or any change in order of the components may be made without departing from the scope and idea of the present disclosure.

The present disclosure is applicable to a piezoelectric pump including a piezoelectric element.

2 piezoelectric pump
4 first top board
6 second top board
9 diaphragm
10 piezoelectric element
12 first side wall
14 second side wall
16 first valve
16A fixed portion (first fixed portion)
16B movable portion (first movable portion)
18 second valve

18A fixed portion (second fixed portion)
18B movable portion (second movable portion)
20 first aperture
21 second aperture
22 third aperture
23 fourth aperture
26 supporter
26A first main surface
26B second main surface
27 outer peripheral edge
28 vibrator
30 frame
32 first pump chamber
34 second pump chamber
36 wire
38 first electrode
40 second electrode
42 insulating region
44 first wire
46 second wire
48 vibration node
60 piezoelectric pump
62 first valve
62A third fixed portion
62B third movable portion
64 second valve
64A fourth fixed portion
64B fourth movable portion
66 diaphragm
68A, 68B supporter
70 piezoelectric pump
72 first valve
72A third fixed portion
72B third movable portion
74 second valve
74A fourth fixed portion
74B fourth movable portion
76 first top board
78 second top board
80 first aperture
82 second aperture
84 third aperture
86 fourth aperture
D1 to D4 distance
F1 to F22, F30 to F35, F40 to F45 flow

The invention claimed is:

1. A piezoelectric pump, comprising:

a first top board having a first aperture and a second aperture;

a second top board spaced apart from the first top board and having a third aperture and a fourth aperture;

a diaphragm disposed between the first top board and the second top board, and having a piezoelectric element attached thereto;

a first side wall coupling the first top board and the diaphragm to define a first pump chamber between the first top board and the diaphragm;

a second side wall coupling the second top board and the diaphragm to define a second pump chamber between the second top board and the diaphragm;

a first valve having an annular shape to surround the first aperture while being spaced apart from the first aperture and the second aperture, and disposed in the first pump chamber between the first aperture and the second aperture when viewed in a plan view from a main surface of the first top board toward a main surface of the second top board; and a second valve having an annular shape to surround the third aperture while being spaced apart from the third aperture and the fourth aperture, and disposed in the second pump chamber between the third aperture and the fourth aperture when viewed in a plan view from the main surface of the second top board toward the main surface of the first top board.

2. The piezoelectric pump according to claim 1, wherein the first valve includes a first fixed portion fixed to the first top board, and a first movable portion extending from the first fixed portion, and wherein the second valve includes a second fixed portion fixed to the second top board, and a second movable portion extending from the second fixed portion.

3. The piezoelectric pump according to claim 1, wherein the first valve includes a third fixed portion fixed to the diaphragm, and a third movable portion extending from the third fixed portion, and wherein the second valve includes a fourth fixed portion fixed to the diaphragm, and a fourth movable portion extending from the fourth fixed portion.

4. The piezoelectric pump according to claim 2, wherein the first movable portion of the first valve is disposed on an inner side of the first fixed portion of the first valve when viewed in a plan view from the main surface of the first top board toward the main surface of the second top board, and wherein the second movable portion of the second valve is disposed on an inner side of the second fixed portion of the second valve when viewed in a plan view from the main surface of the second top board toward the main surface of the first top board.

5. The piezoelectric pump according to claim 3, wherein the third movable portion of the first valve is disposed on an inner side of the third fixed portion of the first valve when viewed in a plan view from the main surface of the first top board toward the main surface of the second top board, and wherein the fourth movable portion of the second valve is disposed on an inner side of the fourth fixed portion of the second valve when viewed in a plan view from the main surface of the second top board toward the main surface of the first top board.

6. The piezoelectric pump according to claim 2, wherein the first movable portion of the first valve is disposed on an outer side of the first fixed portion of the first valve when viewed in a plan view from the main surface of the first top board toward the main surface of the second top board, and wherein the second movable portion of the second valve is disposed on an outer side of the second fixed portion of the second valve when viewed in a plan view from the main surface of the second top board toward the main surface of the first top board.

7. The piezoelectric pump according to claim 3, wherein the third movable portion of the first valve is disposed on an outer side of the third fixed portion of the first valve when viewed in a plan view from the main surface of the first top board toward the main surface of the second top board, and wherein the fourth movable portion of the second valve is disposed on an outer side of the fourth fixed portion of the second valve when viewed in a plan view from the main surface of the second top board toward the main surface of the first top board.

8. The piezoelectric pump according to claim 1, wherein the diaphragm separates the first pump chamber from the second pump chamber to disable connection between the first pump chamber and the second pump chamber.

9. The piezoelectric pump according to claim 1, wherein the diaphragm includes a supporter including a first main surface having the piezoelectric element attached thereto, and the supporter supporting the piezoelectric element, a vibrator attached to a second main surface of the supporter at a position across from the piezoelectric element, and a frame attached to the second main surface of the supporter at a position between the first side wall and the second side wall while being spaced apart from the vibrator.

10. The piezoelectric pump according to claim 9, wherein an outer peripheral edge of the vibrator is disposed at a position different from a position serving as a vibration node of the vibrator.

11. The piezoelectric pump according to claim 9, wherein the supporter comprises a material having a lower modulus of elasticity than the vibrator.

12. The piezoelectric pump according to claim 11, wherein the supporter is thinner than the vibrator.

13. The piezoelectric pump according to claim 2, wherein the diaphragm separates the first pump chamber from the second pump chamber to disable connection between the first pump chamber and the second pump chamber.

14. The piezoelectric pump according to claim 3, wherein the diaphragm separates the first pump chamber from the second pump chamber to disable connection between the first pump chamber and the second pump chamber.

15. The piezoelectric pump according to claim 4, wherein the diaphragm separates the first pump chamber from the second pump chamber to disable connection between the first pump chamber and the second pump chamber.

16. The piezoelectric pump according to claim 5, wherein the diaphragm separates the first pump chamber from the second pump chamber to disable connection between the first pump chamber and the second pump chamber.

17. The piezoelectric pump according to claim 6, wherein the diaphragm separates the first pump chamber from the second pump chamber to disable connection between the first pump chamber and the second pump chamber.

18. The piezoelectric pump according to claim 7, wherein the diaphragm separates the first pump chamber from the second pump chamber to disable connection between the first pump chamber and the second pump chamber.

19. The piezoelectric pump according to claim 2, wherein the diaphragm includes a supporter including a first main surface having the piezoelectric element attached thereto, and the supporter supporting the piezoelectric element, a vibrator attached to a second main surface of the supporter at a position across from the piezoelectric element, and a frame attached to the second main surface of the supporter at a position between the first side wall and the second side wall while being spaced apart from the vibrator.

20. The piezoelectric pump according to claim 3, wherein the diaphragm includes a supporter including a first main surface having the piezoelectric element attached thereto, and the supporter supporting the piezoelectric element, a vibrator attached to a second main surface of the supporter at a position across from the piezoelectric element, and a frame attached to the second main surface of the supporter at a position between the first side wall and the second side wall while being spaced apart from the vibrator.

* * * * *